US008926867B2

(12) United States Patent
Gomes et al.

(10) Patent No.: US 8,926,867 B2
(45) Date of Patent: Jan. 6, 2015

(54) USE OF FRUIT SKIN EXTRACTS AS CORROSION INHIBITORS AND PROCESS FOR PRODUCING SAME

(75) Inventors: Jose Antonio da Cunha Ponciano Gomes, Petropolis (BR); Janaina Cardoso Rocha, Sao Joao de Meriti (BR); Eliane D'Elia, Rio de Janeiro (BR)

(73) Assignee: COPPE/UFRJ—Instituto Alberto Luiz Colmbra de Pos Graduacao e Pesquisa de Engenharia, Rio de Janeiro (BR)

( * ) Notice: Subject to any disclaimer, the term of this patent is extended or adjusted under 35 U.S.C. 154(b) by 731 days.

(21) Appl. No.: 13/142,958

(22) PCT Filed: Jan. 7, 2010

(86) PCT No.: PCT/BR2010/000001

§ 371 (c)(1),
(2), (4) Date: Jun. 30, 2011

(87) PCT Pub. No.: WO2010/078633

PCT Pub. Date: Jul. 15, 2010

(65) Prior Publication Data

US 2011/0266502 A1 Nov. 3, 2011

(30) Foreign Application Priority Data

Jan. 8, 2009 (BR) ..... 0902012

(51) Int. Cl.
*B01D 11/04* (2006.01)
*C23F 11/10* (2006.01)

(52) U.S. Cl.
CPC ..... *C23F 11/10* (2013.01)
USPC ..... 252/398; 252/388; 252/393; 252/396; 210/634

(58) Field of Classification Search
CPC .... B01D 11/0492; B01D 11/04; B01D 11/02; B01D 11/0415; C23F 11/10
USPC ..... 252/398, 388, 393, 396; 210/634
See application file for complete search history.

(56) References Cited

U.S. PATENT DOCUMENTS

| | | | | |
|---|---|---|---|---|
| 7,192,731 | B2 * | 3/2007 | Kanner et al. | 435/19 |
| 7,572,468 | B1 * | 8/2009 | Ishida et al. | 424/725 |
| 8,765,442 | B2 * | 7/2014 | Gronfeldt | 435/225 |
| 2012/0028332 | A1 * | 2/2012 | Gronfeldt | 435/188 |
| 2012/0202262 | A9 * | 8/2012 | Gronfeldt | 435/188 |

OTHER PUBLICATIONS

Gomes, Antonio Wilson Moura, *Inhibidores naturais de corrosao extraidos em vegetais tropicais*, Tese de Doutorado, Universidae Estadual de Campinas, Campinas, SP, 1999. pp. 26 ,29 ,32 ,35 ,37 , 41 ,79 ,81, Tables 11, 12, figure 32.

Nascimento, M.C.V., Amado, R.S., D'Elia, E., *Efeito inhibidor do extrato de milho (Zea mays* L) *na corrosao do Aco-carbono 1020 em meio acido cloridrico 1 mol.L-1*, 31* Reuniao annual da Sociedade Brasileira de Quimica (SBQ), Aguas de Lindoia, SP, 26 a May 29, 2008. Coluna 1, linhas 8, 17, 18 and 22.

Assuncao, S.S., Amado, R.S., D'Elia, E., *Extrato de alho como inhibidor natural de corrosao do aco-carbono 1020 em meio acido clordrico*, 48* Congresso Brasileiro de Quimica, RJ, Rio de Janeiro, 29 a Mar. 10, 2008. Linhas 4, 6, 20 and 26.

* cited by examiner

*Primary Examiner* — Douglas McGinty
(74) *Attorney, Agent, or Firm* — Fildes & Outland, P.C.

(57) ABSTRACT

The present invention relates to the use of fruit skin extracts as corrosion inhibitors, more particularly to the use of the skin of fruits such as mango, cashew, passion-fruit and orange, inter alia, more specifically as corrosion inhibitors for steel in an acid medium, preferably carbon steel 1020 in a 1 mole/$L^{-1}$ hydrochloric acid medium, and also for various types of steel, metals such as copper and copper alloys, inter alia, in neutral and basic media, and to the process for producing same.

5 Claims, 6 Drawing Sheets

USE OF FRUIT SKIN EXTRACTS AS CORROSION INHIBITORS AND PROCESS FOR PRODUCING SAME

TECHNICAL FIELD

The proposed innovation refers to the use of extracts from the skin of fruits such as corrosion inhibitors, specifically the use of the peel of fruits such as mango, cashew, passion fruit and orange, among others, more specifically as corrosion inhibitors for steel in acid medium, preferably the 1020 carbon steel in hydrochloric acid medium 1 mol $L^{-1}$ and also for various types of steel, metals such as copper and copper alloys, among others in neutral and alkaline media.

PREVIOUS TECHNIQUES

Corrosion is the deterioration of a material due to its interaction with the environment and represents a huge economic loss. It is estimated that the total annual cost of corrosion in industrialized cities is around 4% of gross national product. Due to the great economic damage, corrosion has been and remains the subject of extensive studies, especially for the purpose of its inhibition with an acceptable cost, both economically and environmental developments. One of the ways to combat corrosion is to use corrosion inhibitors. Corrosion inhibitors are used in various industrial segments. Currently there is an environmental concern in order to minimize the use of toxic and non-compatible with the environment, thus avoiding impacts and environmental liabilities. The search, therefore, a corrosion inhibitor environmentally appropriate to reduce or eliminate the use of toxic solvents or generation of products or byproducts that are harmful to health or the environment, is a current need. These inhibitors are known as natural inhibitors, green or ecological and have been studied in recent years.

The natural inhibitors of corrosion are inhibitors derived from some plant extracts or biodegradable material and cause the reduction of dissolved metal, reducing its corrosion. Research in recant years has reported many plant compounds with antioxidant activity in its constitution. [1]

The use of inhibitors to control corrosion of metals and alloys that are in contact with aggressive media, in practice, is approved. Studies of the inhibitory action of organic compounds showed that compounds, especially with N, S and O, showed efficient inhibitory effect. [2]

El-Etre et al. (2000) studied a natural honey, extracted from different types of flowers peculiar to the region of Egypt, as corrosion inhibitors of carbon steel used in the lines of pipelines in the oil industry. They showed that the organic compounds that exist in this natural substance, showed inhibitory action of corrosion of carbon steel in water with high salinity, formation water from oil fields, where significant concentrations of Cl—, Br—, $SO_4^{-2}$. [3]

Patent US20080183769 (A1) from Von Frounhofer et al. (2008) describes the use of tobacco as a corrosion inhibitor in concrete structures. They said the corrosion of steel rebar cracks and chips the concrete surface. The main causes of corrosion in concrete are the chloride penetration and carbonation. The inhibitor most used in media containing chloride is calcium nitrite, and new inhibitors are required due to this high solubility in water and its toxicity. The addition of inhibitors increases the cost of concrete and may affect the environment. In the invention in question is the tobacco used to protect steel embedded in concrete from corrosive attack. These types of inhibitors are low cost low environmental impact and protect the steel from aggressive ions in neutral, acid and alkaline. Tobacco parts used were leaves, stems, roots and seeds. They were dried and crushed and added to the components of concrete. A powder obtained from tobacco extract was also added to the components of concrete and tested as a corrosion inhibitor. The extract was made by placing parts of the crushed and dried tobacco into boiling water in a ratio of 60 to 300 g of tobacco in 1000 ml of water for a period of 1 to 24 hours. Nonpolar solvents can be used prior to aqueous extraction to remove organic compounds more support. The residue from tobacco pulp filtrate can be discarded or used for other applications such as source for biofuel, fertilizer, filling and etc. The extract is concentrated to remove excess of water by evaporation or other drying technique, which can be the evaporation technique for static or circulating air at room temperature or higher. [4]

U.S. Pat. Nos. 5,435,941 and 6,602,555 Von Fraunhofer et at (1995 and 2003, respectively) reports the use of tobacco extracts as corrosion inhibitors to minimize the amount of corrosion that occurs in cells of galvanic corrosion that are established in areas of union of metals with different electrochemical potentials. The results showed that tobacco extracts inhibited these cells corrosion of galvanic corrosion in NaCl with 1% more than the addition of potassium chromate, commonly used with a corrosion inhibitor. [5]

In Brazil, the processing of agricultural products for the extraction of juices, sauces and oils for human consumption generates a lot of products coming from industrial processes such as seeds, pulp and peel. [6]

The amount of waste (skin more seeds) produced per ton of processed juice is quite expressive. It is very important that an increasing number of solutions for the recovery of waste is proposed, which can only be encouraging the development of research which are still incipient in the sector. [7]

Brazil is one of the three largest producers of fruits, whose production exceeds 34 million tones. However, losses arising from the waste of fruit and vegetables are around 30 to 40% of production. [8]

During the processing of fruit juice, the peel is the main byproduct. If untreated, the peel becomes a waste and a possible source of environmental pollution. In fact, phytochemicals that contribute to health (e.g., flavonoids, carotenoids and pectin) are abundant in citrus skin. The high amount of flavonoids occurs in the peel. [9]

Thus, the innovation described proposes a new application for environmental inhibitors, which with the rising demand for the recovery of waste generated by industry, presents alternatives to inhibitors which are less aggressive nature, with low cost and good efficiency. As described inhibitor efficiency (IE) of extracts from skin of fruits coming from the juice industry in the 1020 dissolution of carbon steel in hydrochloric acid 1 mol·$L^{-1}$. The aqueous extracts analyzed were skin from cashew, passion fruit, orange and mango. Tests were conducted at different concentrations of the extracts, ranging from 100 to 800 ppm depending on the extract used, and also tests in the absence of inhibitor. The main constituents of the peel of these fruits can be seen in Table 1. The electrochemical behavior of carbon steel was investigated by electrochemical impedance measurements, anodic polarization and cathodic curves and mass loss tests at room temperature for each solution.

TABLE 1

MAJOR CONSTITUENTS OF PEEL

| Skin | Major Constituents |
|---|---|
| Cashew | Carotenoids and phenolic compounds |
| Passion fruit | Flavonoids, alkaloids and pectin |
| Orange | Flavonoids, carotenoids and pectin |
| Mango | Polyphenols, carotenoids, enzymes and fiber |

The extracts of skin of fruits appeared to be good natural inhibitors of corrosion for carbon steel 1020 in acidic chloride 1 mol $L^{-1}$. The best result of EI extracts from polarization resistance was obtained for the extract of orange peel, with EI equal to 95% at a concentration of 400 ppm, we can see the impedance diagrams of the extract of orange peel FIG. 2. The results of EIS data were obtained at the corrosion potential. The lowest number of EI in the extracts were obtained for the peel of cashew with EI equal to 80% at a concentration of 800 ppm, we see this result in FIG. 3. We can observe the electrochemical impedance diagrams that increasing the concentration of the extract causes an increase in polarization resistance for all samples analyzed.

Regarding corrosion potential, we can see that the values were not displaced by the addition of the extracts at anodic polarization and cathodic curves. The results of polarization curves showed significant inhibition in both the cathodic and anodic polarization in the presence of all extracts analyzed by towering the current density, as can be seen in the figures.

The trials of weight loss for the extracts of fruit peel at different times confirmed the results obtained by electrochemical tests showed that the extracts from mangos, oranges, passion fruit and cashews are good corrosion inhibitors. The results of weight loss for a soak time of 24 hours showed that the extracts described almost the same EI as we can see in Table 3.

DETAILED DESCRIPTION OF THE INVENTION

Figure 1A:
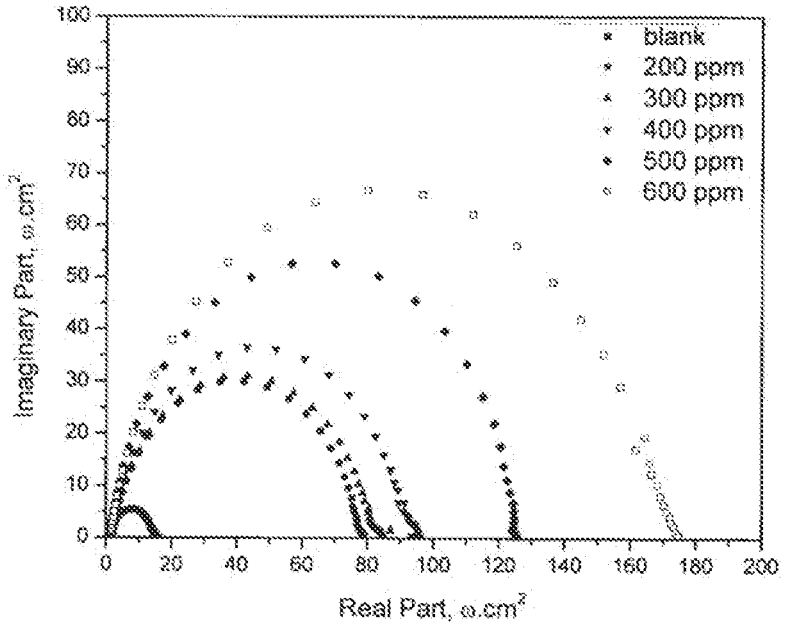
FIG. 1(A) is a graph depicting an electrochemical impedance diagram electrochemical measurement results obtained for 1020 carbon steel in hydrochloric acid solution 1 mol/L in the absence and presence of mango peel extract in different concentrations.

The present invention describes the use of peel extract of fruits such as corrosion inhibitors, where the skin is the raw material to obtain extracts rich in antioxidants.

The process of obtaining these extracts began with washing the fruit in water, with subsequent improvements in their skin, which are air dried and ground through a blender.

Extracts were obtained by water infusion: a mass of about 5 g of dried and crushed peel was added to a beaker containing 100 mL of freshly boiled hot distilled water and left it at home, away from heat for 30 minutes, stirring up sporadically. After extraction, filtration was performed, and this volume was lyophilized extract was stored in a desiccator until the analysis.

Electrochemical tests were performed after stabilization of the potential, which occurred in about 30 minutes.

The medium used was a naturally aerated aqueous solution of hydrochloric acid (Merck) 1 mol $L^{-1}$. This corrosive medium is widely used in petroleum industry, being used in acid pickling baths.

Hydrochloric acid is a major acids used in cleaning and surface treatment. Besides the desired action for the dissolution of iron oxides, these acids are corrosive to the metal base with hydrogen evolution, which leads to many drawbacks. Thus, the industry of pickling inhibitors, whose action is mainly based on the adsorption, acquired large.

DESCRIPTION OF PREFERRED TERMS

One embodiment of the present invention describes the use of peel extract of passion fruit and cashew as corrosion inhibitor for carbon steel 1020 in the hydrochloric acid medium 1 mol $L^{-1}$. These two extracts were obtained by extracting only by infusion, as previously described.

A second embodiment of the present invention describes the use of peel extract of mango and orange as corrosion inhibitor for carbon steel 1020 in the hydrochloric acid medium 1 mol L−1. These two extracts were also obtained by extracting an infusion and a different methodology, in order to compare the results to determine a best type of extraction. These other method used to obtain the extract of fruit peel was extraction by gradient polarity (gp). This was only used the orange and mango skin showed the best results. To obtain the extracts, we used certain mass, which was added to a cartridge made for the hot extraction in a soxhlet type apparatus. Was extracted with solvents of increasing polarity: hexane, ethyl acetate and ethanol, among others and last held extraction in distilled water for infusion. Each with a specific solvent extraction was performed until the solution stayed colorless glass of hexane, which represents a time variable for each extract. For every change of solvent in the soxhlet apparatus, the residual mass, obtained from the previous extraction was dried outdoors for 24 hours before the next extraction. After infusion the extracts were freeze dried and stored in a desiccator until the analysis.

The description of the preferred embodiments and examples presented below, should not be considered as limiting the scope of the present invention, since the said extracts of fruit peel may have their application as corrosion inhibitors, not only of carbon steel, but also other types of steel and metals such as copper and copper alloys, among others, in neutral and alkaline media.

EXAMPLES

1. Mass Loss

TABLE 2

Tests for loss of mass in the extracts of fruit peel at different times.

| | Corrosionrate, g/cm$^2$ | | |
|---|---|---|---|
| Analysis | 1 hour | 4 hours | 24 hours |
| White | 0.002114 | 0.0078940 | 0.041800 |
| Mango peel | 0.0007063 | 0.0015600 | 0.001841 |
| Orange peel | 0.0002624 | 0.0005937 | 0.001969 |
| Cashew peel | 0.0006228 | 0.0014370 | 0.003059 |
| Passion fruit peel | 0.0004636 | 0.0012590 | 0.001525 |
| GP mango peel | 0.0005820 | 0.0006669 | 0.001126 |
| GP orange peel | 0.0003567 | 0.0006881 | 0.001910 |

TABLE 3

Efficiency of inhibition for the extracts of fruit skin, obtained through the trials of weight loss.

| | Corrosion rate, g/cm$^2$ | | |
|---|---|---|---|
| Analysis | 1 hour | 4 hours | 24 hours |
| White | — | — | — |
| Mango peel | 67 | 80 | 96 |
| Orange peel | 88 | 92 | 95 |
| Cashew peel | 71 | 82 | 93 |
| Passion fruit peel | 78 | 84 | 96 |
| GP mango peel | 72 | 92 | 97 |
| GP orange peel | 83 | 91 | 95 |

Figure 1B:
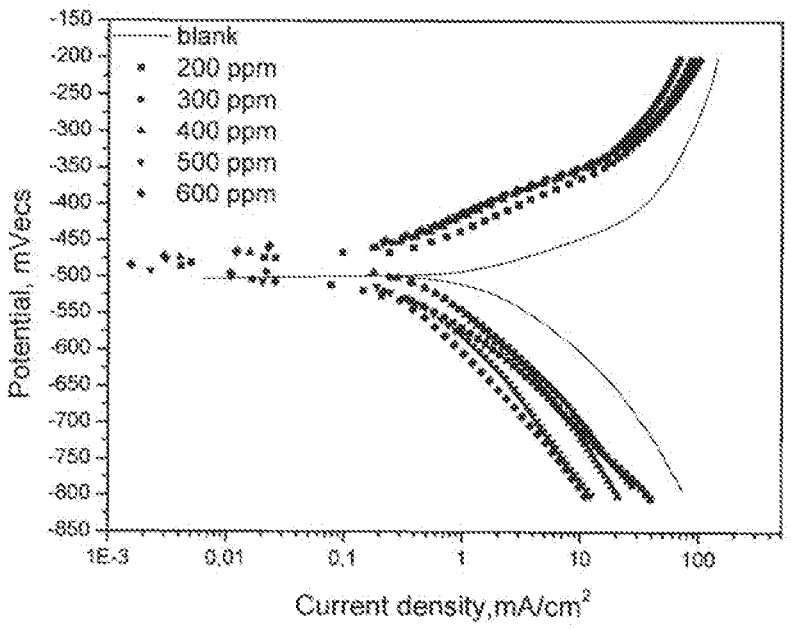
FIG. 1(B) is a graph depicting anodic and cathodic polarization electrochemical measurement results obtained for 1020 carbon steel in hydrochloric acid solution 1 mol/L in the absence and presence of mango peel extract in different concentrations.

2. Electrochemical Measurements 2.1 Results Obtained from the Peel Extract of Mango:

in the graphs presented in FIGS. 1(A) and 1(B) depicts the electrochemical impedance diagrams (left) and anodic and cathodic polarization (right), obtained for 1020 carbon steel in hydrochloric acid solution 1 mol $L^{-1}$ in the absence and presence of mango peel extract in different concentrations.

Figure 2A:
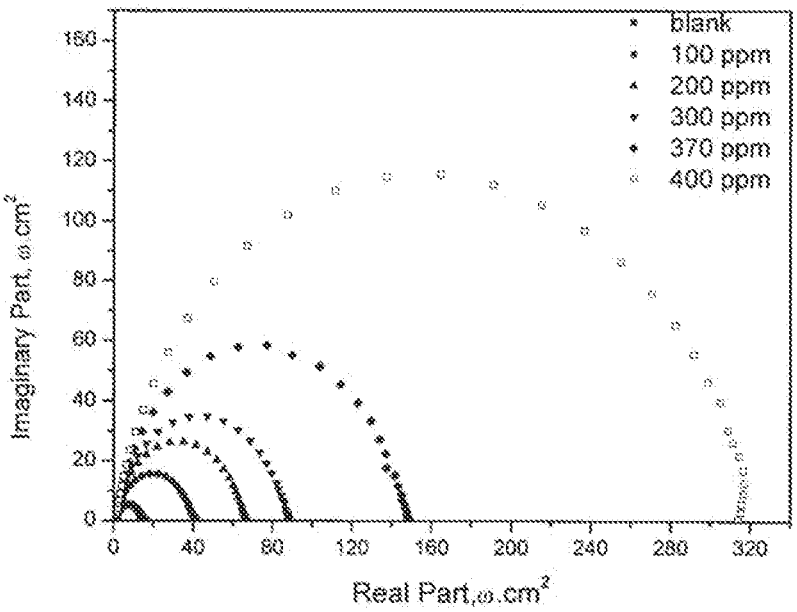
FIG. 2(A) is a graph depicting an electrochemical impedance diagram electrochemical measurement results obtained for 1020 carbon steel in hydrochloric acid solution 1 mol/L in the absence and presence of orange peel extract in different concentrations.
Figure 2B:
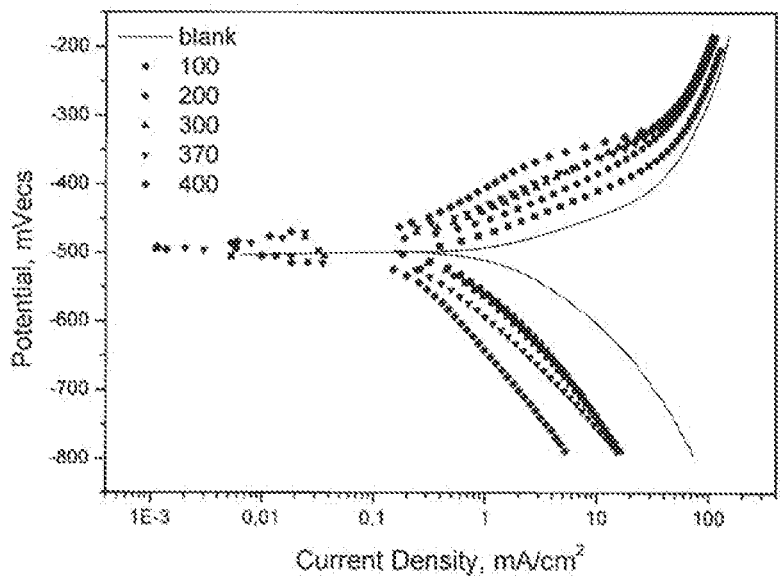
FIG. 2(B) is a graph depicting anodic and cathodic polarization electrochemical measurement results obtained for 1020 carbon steel in hydrochloric acid solution 1 mol/L in the absence and presence of orange peel extract in different concentrations.

2.2 Results Obtained from the Peel Extract of Orange:

In the graphs presented in FIGS. 2(A) and 2(B) depicts the electrochemical impedance diagrams (left) and anodic and cathodic polarization (right), obtained for 1020 carbon steel in hydrochloric acid solution 1 mol $L^{-1}$ in the absence and presence of orange peel extract in different concentrations.

Figure 3A:
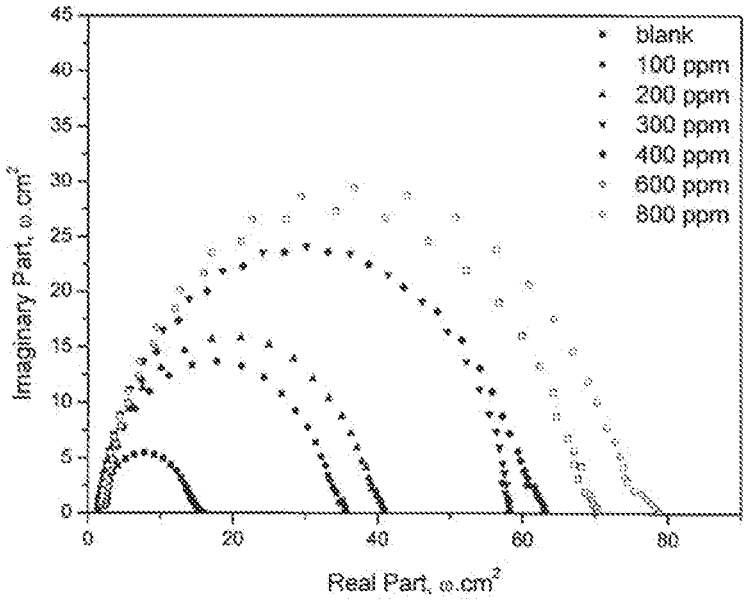
FIG. 3(A) is a graph depicting an electrochemical impedance diagram electrochemical measurement results obtained for 1020 carbon steel in hydrochloric acid solution 1 mol/L in the absence and presence of cashew peel extract in different concentrations.
Figure 3B:
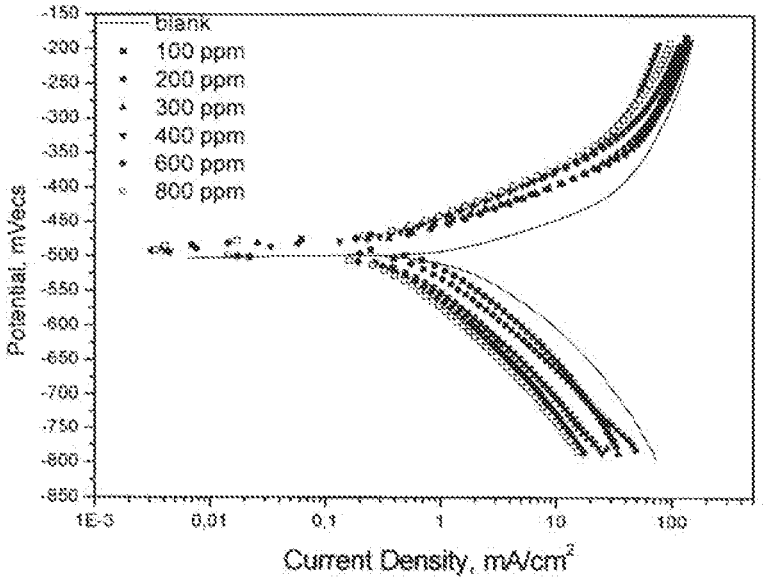
FIG. 3(B) is a graph depicting anodic and cathodic polarization electrochemical measurement results obtained for 1020 carbon steel in hydrochloric acid solution 1 mol/L in the absence and presence of cashew peel extract in different concentrations.

2.3 Results Obtained from the Peel Extract of Cashew:

In the graphs presented in FIGS. 3(A) and 3(B) depicts the electrochemical impedance diagrams (left) and anodic and cathodic polarization (right), obtained for 1020 carbon steel in hydrochloric add solution 1 mol $L^{-1}$ in the absence and presence of cashew peel extract in different concentrations.

Figure 4A:
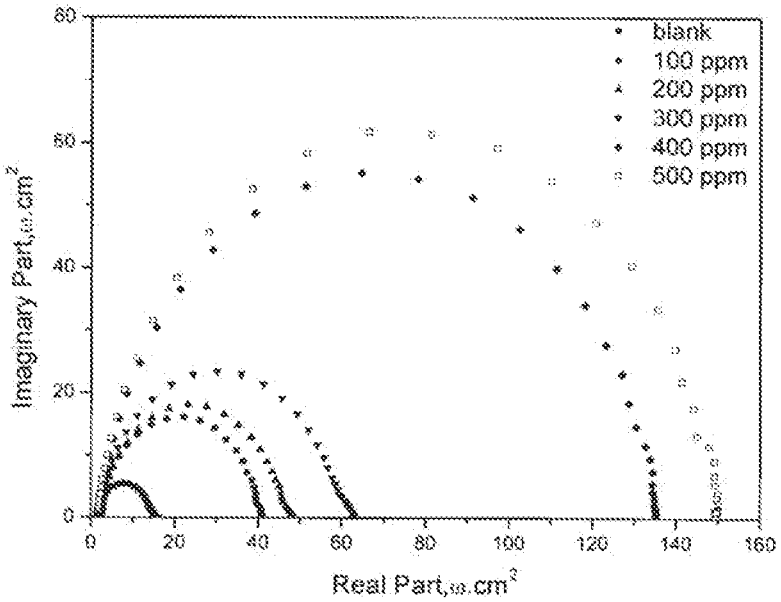
FIG. 4(A) is a graph depicting an electrochemical impedance diagram electrochemical measurement results obtained for 1020 carbon steel in hydrochloric acid solution 1 mol/L in the absence and presence of passion fruit peel extract in different concentrations.
Figure 4B:
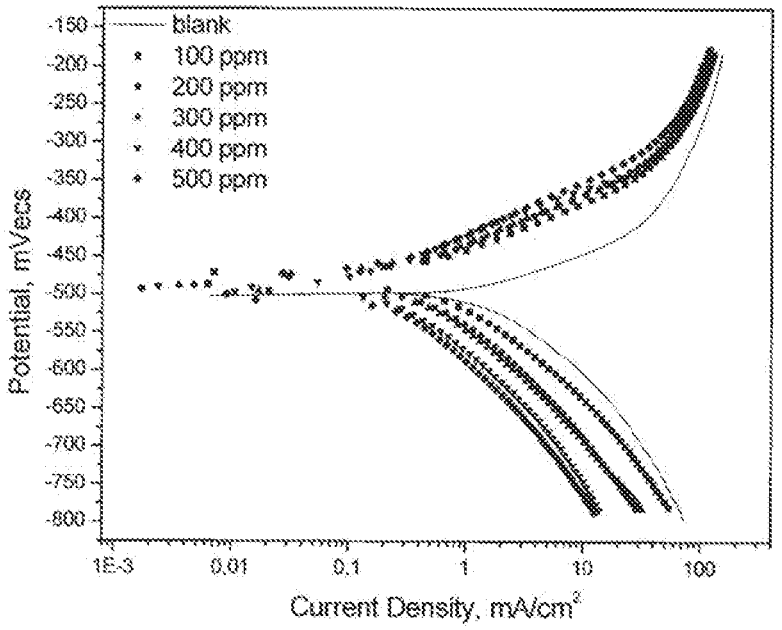
FIG. 4(B) is a graph depicting anodic and cathodic polarization electrochemical measurement results obtained for 1020 carbon steel in hydrochloric acid solution 1 mol/L in the absence and presence of passion fruit peel extract in different concentrations.

2.4 Results Obtained from the Peel Extract of Passion Fruit:

In the graphs presented in FIGS. 4(A) and 4(B) depicts the electrochemical impedance diagrams (left) and anodic and cathodic polarization (right), obtained for 1020 carbon steel in hydrochloric acid solution 1 mol $L^{-1}$ in the absence and presence of passion fruit peel extract in different concentrations.

Figure 5A:
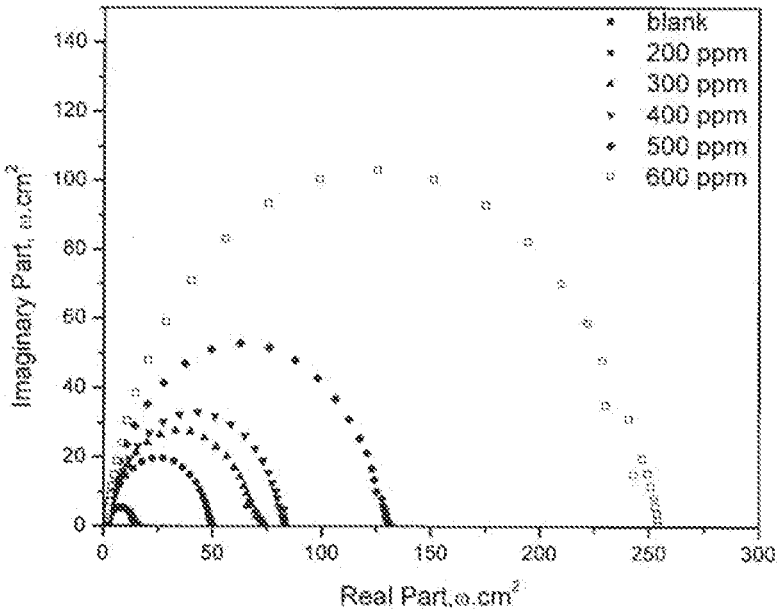
FIG. 5(A) is a graph depicting an electrochemical impedance diagram electrochemical measurement results obtained for 1020 carbon steel in hydrochloric acid solution 1 mol/L in the absence and presence of GP mango fruit peel extract in different concentrations.
Figure 5B:
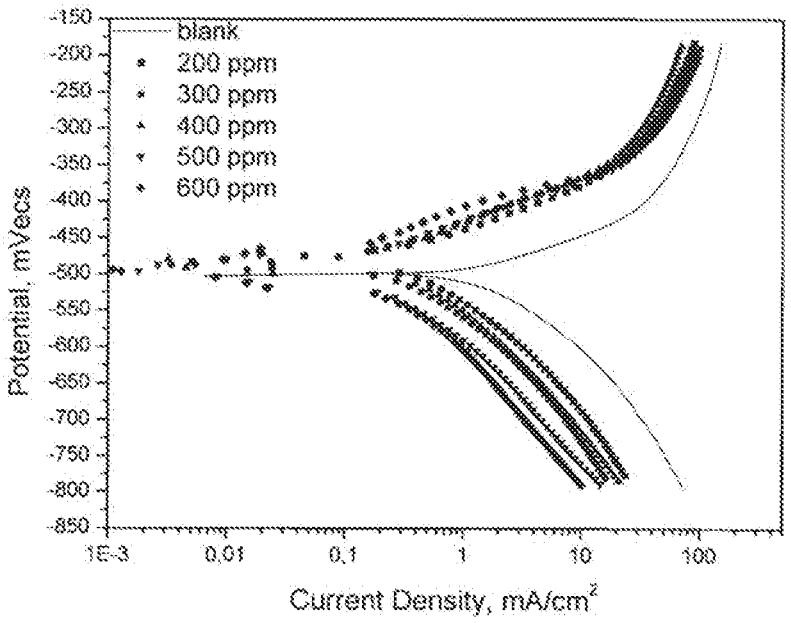
FIG. 5(B) is a graph depicting anodic and cathodic polarization electrochemical measurement results obtained for 1020 carbon steel in hydrochloric acid solution 1 mol/L in the absence and presence of GP mango fruit peel extract in different concentrations.

2.5 Results Obtained from the Peel Extract of GP Mango Fruit:

In the graphs presented in FIGS. 5(A) and 5(B) depicts the electrochemical impedance diagrams (left) and anodic and cathodic polarization (right), obtained for 1020 carbon steel in hydrochloric acid solution 1 mol $L^{-1}$ in the absence and presence of GP mango fruit peel extract in different concentrations.

Figure 6A:
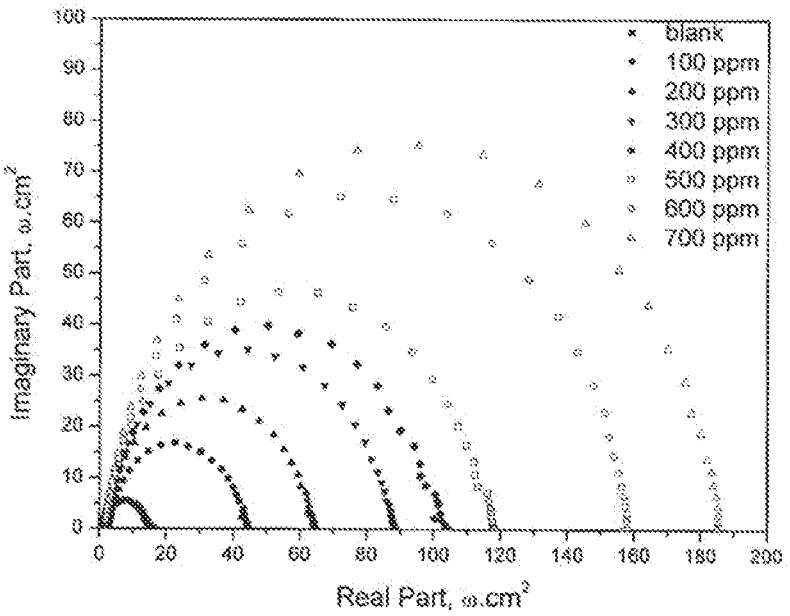
FIG. 6(A) is a graph depicting an electrochemical impedance diagram electrochemical measurement results obtained for 1020 carbon steel in hydrochloric acid solution 1 mol/L in the absence and presence of GP passion fruit peel extract in different concentrations.
Figure 6B:
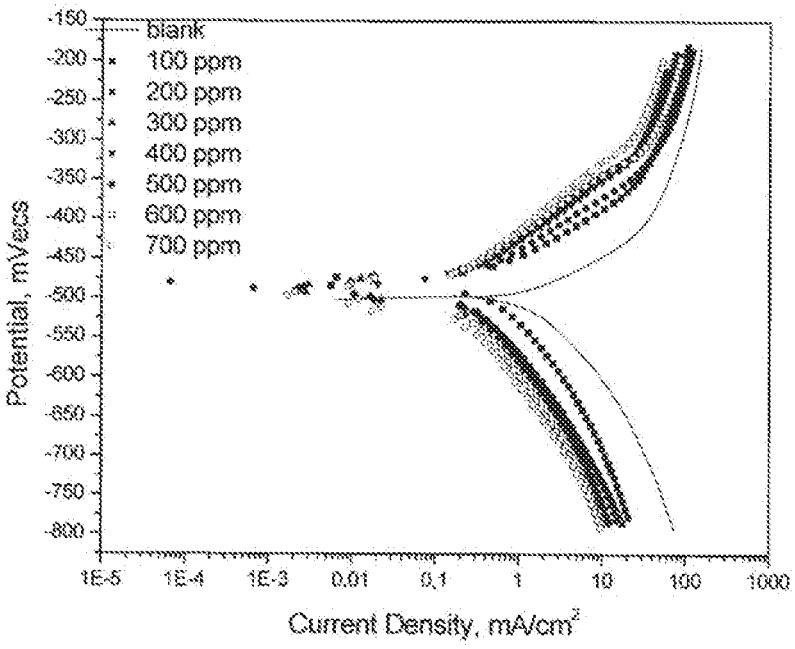
FIG. 6(B) is a graph depicting anodic and cathodic polarization electrochemical measurement results obtained for 1020 carbon steel in hydrochloric acid solution 1 mol/L in the absence and presence of GP passion fruit peel extract in different concentrations.

2.6 Results Obtained from the Peel Extract of GP Passion Fruit:

In the graphs presented in FIGS. 6(A) and 6(B) depicts the electrochemical impedance diagrams (left) and anodic and cathodic polarization (right), obtained for 1020 carbon steel in hydrochloric acid solution 1 mol $L^{-1}$ in the absence and presence of GP passion fruit peel extract in different concentrations.

The invention claimed is:

1. Manufacturing Process of Peel Extract Fruit characterized by obtaining extracts from mangos, oranges, cashew and passion fruit comprising steeping a mass of about 5 g of dried and crushed peel in a beaker containing 100 mL of freshly boiled hot distilled water and removing from heat for 30 minutes, stirring it occasionally with subsequent filtration and lyophilization of the extract obtained.

2. Manufacturing Process of Peel Extract Fruit characterized by preferential production of said extracts from mangos and oranges, using a certain mass, which was added to a cartridge made for the hot extraction in a soxhlet type apparatus, which was extracted with solvents of increasing polarity, and finally performing the extraction in water for infusion, with subsequent filtration and lyophilization of the extract obtained.

3. Process according to claim 2, characterized by solvent extraction to be performed until the solution remains colorless on soxhlet glass.

4. Process according to claim 2, characterized by being solvents of increasing polarity, such as hexane, ethyl acetate and ethanol, among others.

5. Process according to claim 2, characterized by more peel extract from fruits like mango and orange, among others.

* * * * *